US006086429A

United States Patent [19]

Wu

[11] Patent Number: 6,086,429

[45] Date of Patent: Jul. 11, 2000

[54] LOW PROFILE CONNECTOR

[75] Inventor: Kun-Tsasn Wu, Tu-Chen, Taiwan

[73] Assignee: Hon Hai Precision Ind. Co., Ltd., Taipei Hsien, Taiwan

[21] Appl. No.: 09/270,299

[22] Filed: Mar. 15, 1999

[30] Foreign Application Priority Data

Mar. 13, 1998 [TW] Taiwan ..... 87203750

[51] Int. Cl.[7] ..... H01R 23/02

[52] U.S. Cl. ..... 439/676; 439/607

[58] Field of Search ..... 439/676, 76.1, 439/607

[56] References Cited

U.S. PATENT DOCUMENTS

| | | | |
|---|---|---|---|
| 4,698,025 | 10/1987 | Silbernagel et al. | 439/676 |
| 5,118,311 | 6/1992 | Margini | 439/676 |
| 5,364,294 | 11/1994 | Hatch et al. | 439/676 |
| 5,378,172 | 1/1995 | Roberts | 439/607 |
| 5,687,478 | 11/1997 | Belopolsky | 439/676 |
| 5,766,043 | 6/1998 | Talend | 439/676 |
| 5,768,110 | 6/1998 | Frommer et al. | 439/76.1 |
| 5,823,796 | 10/1998 | Bethurum | 439/76.1 |
| 5,842,886 | 12/1998 | Illg et al. | 439/607 |
| 5,879,193 | 3/1999 | Thenaisie et al. | 439/607 |
| 5,879,199 | 3/1999 | Belopolsky | 439/676 |

*Primary Examiner*—Neil Abrams
*Assistant Examiner*—Hae Moon Hyeon
*Attorney, Agent, or Firm*—Wei Te Chung

[57] ABSTRACT

An electrical connector, comprises a dielectric housing defining front, rear, top, bottom and side walls. The front wall defines a receiving chamber therein. An insert detachably is assembled to the rear wall of the housing. The insert carries terminals each having a connecting arm extending into the receiving chamber. A pair of wedges is formed on the side walls whereby the housing is snugly disposed in a recess defined in a printed circuit board. An EMI shield is assembled to the housing. The EMI shield defines a pair of slots having its sides snugly received in retaining grooves defined in the wedges.

7 Claims, 9 Drawing Sheets

LOW PROFILE CONNECTOR

FIELD OF THE INVENTION

The present invention relates to an electrical connector, and more particularly to an electrical connector with positioning means for securely assembled to a printed circuit board.

DESCRIPTION OF THE PRIOR ART

Connections between soldering tails of a connector and conductive pads of a printed circuit board is facilitated by an oven in which the printed circuit board together with the connector passes. In order to ensure accurate alignments between the soldering tails and the conductive pads, the connector is assembled with positioning means, such as board locks, securely attached to the printed circuit board. The conventional board locks or posts are formed on a bottom face of a housing of a connector. When the connector is assembled to the printed circuit board, the bottom face of the connector abuts against the printed circuit board, see FIG. 1. If the printed circuit board is assembled with other electrical components at a bottom surface thereof, the overall height will be inevitably increased, see FIG. 2.

In addition, most connectors are assembled with EMI shield to eliminate electrical interference. If the EMI shield is not securely attached to the housing, repeated insertion/withdraw will jeopardize the engagement between the EMI and the housing resulting poor shielding performance. Furthermore, each connector has a mating opening for a complementary connector which limits the pursuit of the compact design.

SUMMARY OF THE INVENTION

An objective of this invention is to provide an electrical connector which has a low profile after assembly to a printed circuit board.

Another objective of this invention is to provide an electrical connector having an EMI shield securely assembled thereto.

In order to achieve the objective set forth, an electrical connector in accordance with the present invention comprises a dielectric housing defining front, rear, top, bottom and side walls. The front wall defines a receiving chamber therein. An insert detachably is assembled to the rear wall of the housing. The insert carries terminals each having a connecting arm extending into the receiving chamber. A pair of wedges is formed on the side walls whereby the housing is snugly disposed in a recess defined in a printed circuit board. An EMI shield is assembled to the housing. The EMI shield defines a pair of slots having its sides snugly received in retaining grooves defined in the wedges.

These and additional objects, features, and advantages of the present invention will become apparent after reading the following detailed description of the preferred embodiments of the invention taken in conjunction with the appended drawing.

DETAILED DESCRIPTION OF PREFERRED EMBODIMENT

Figure 1:
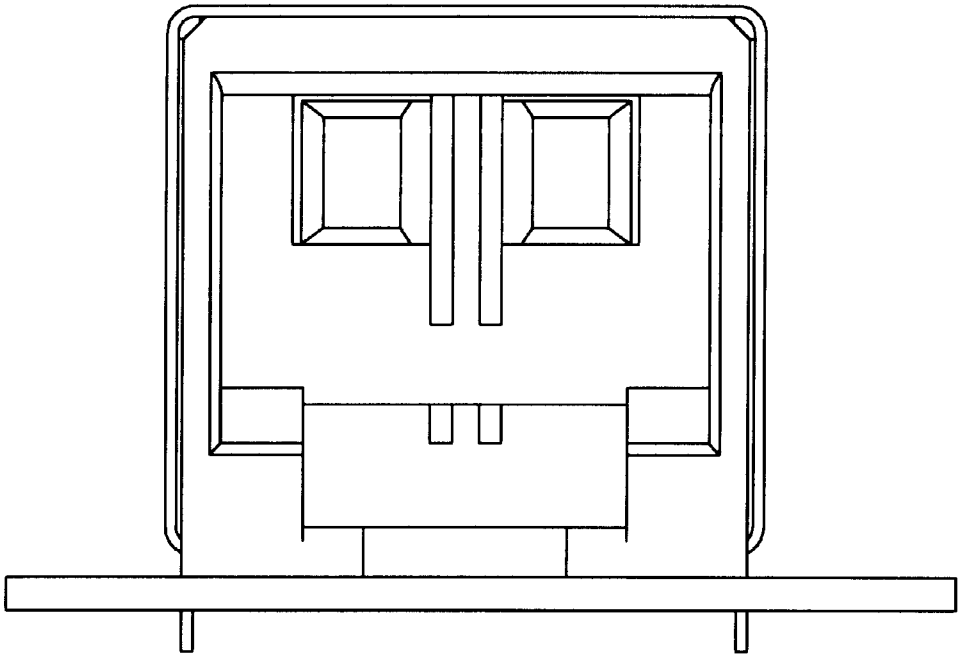
FIG. 1 (PRIOR ART)
FIG. 1 is a front view of a conventional connector assembled to a printed circuit board.
Figure 2:
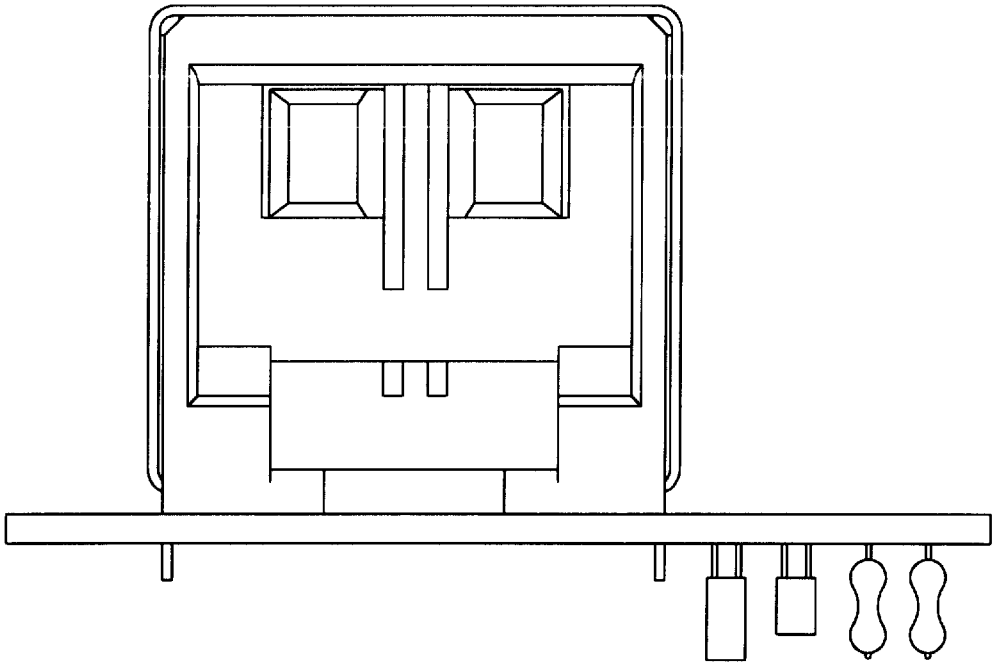
FIG. 2 (PRIOR ART)
FIG. 2 is still a front view of a conventional connector assembled to a printed circuit board having electrical components attached to a bottom face thereof.
Figure 3:
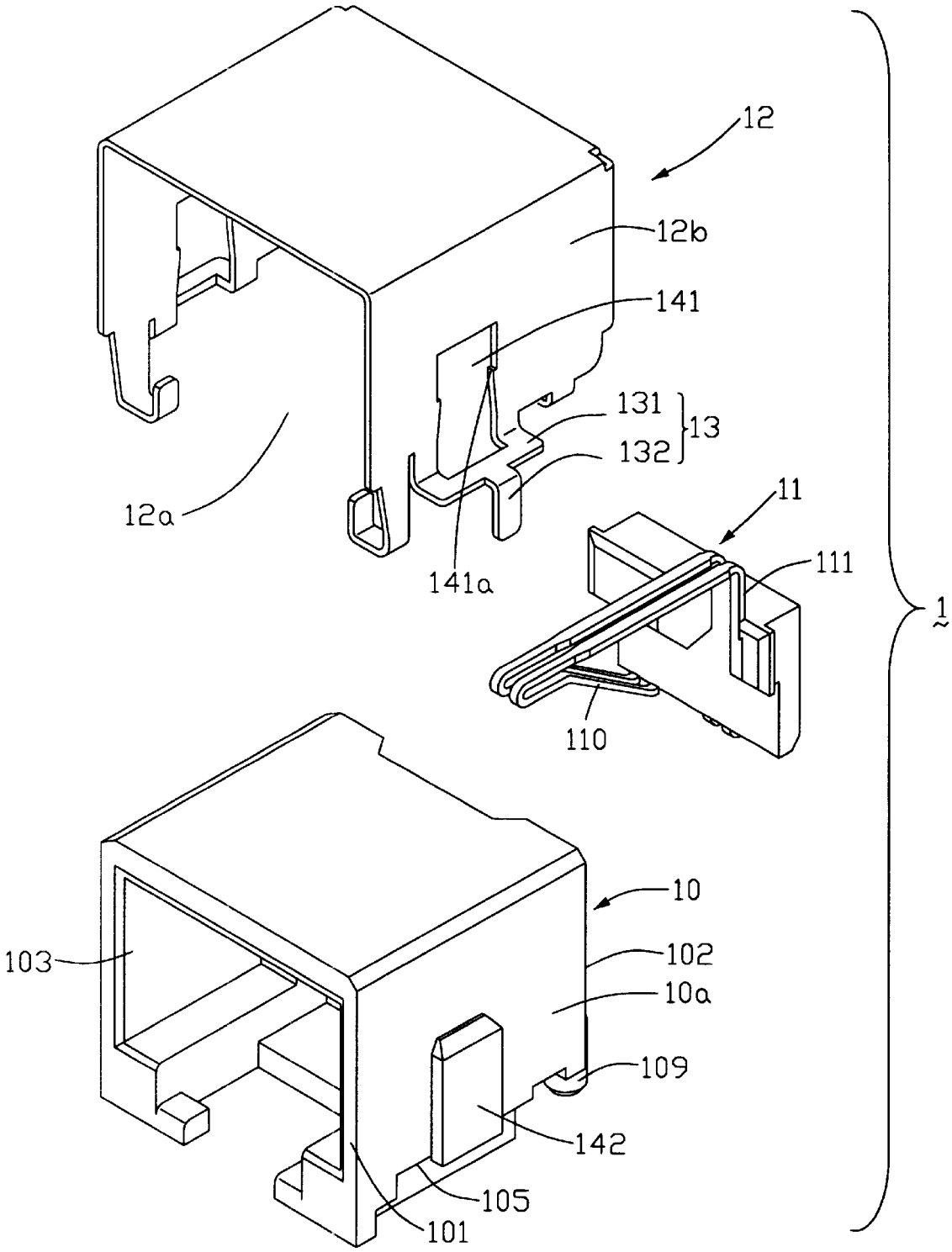
FIG. 3 is an exploded view of an electrical connector in accordance with the present invention.
Figure 4:
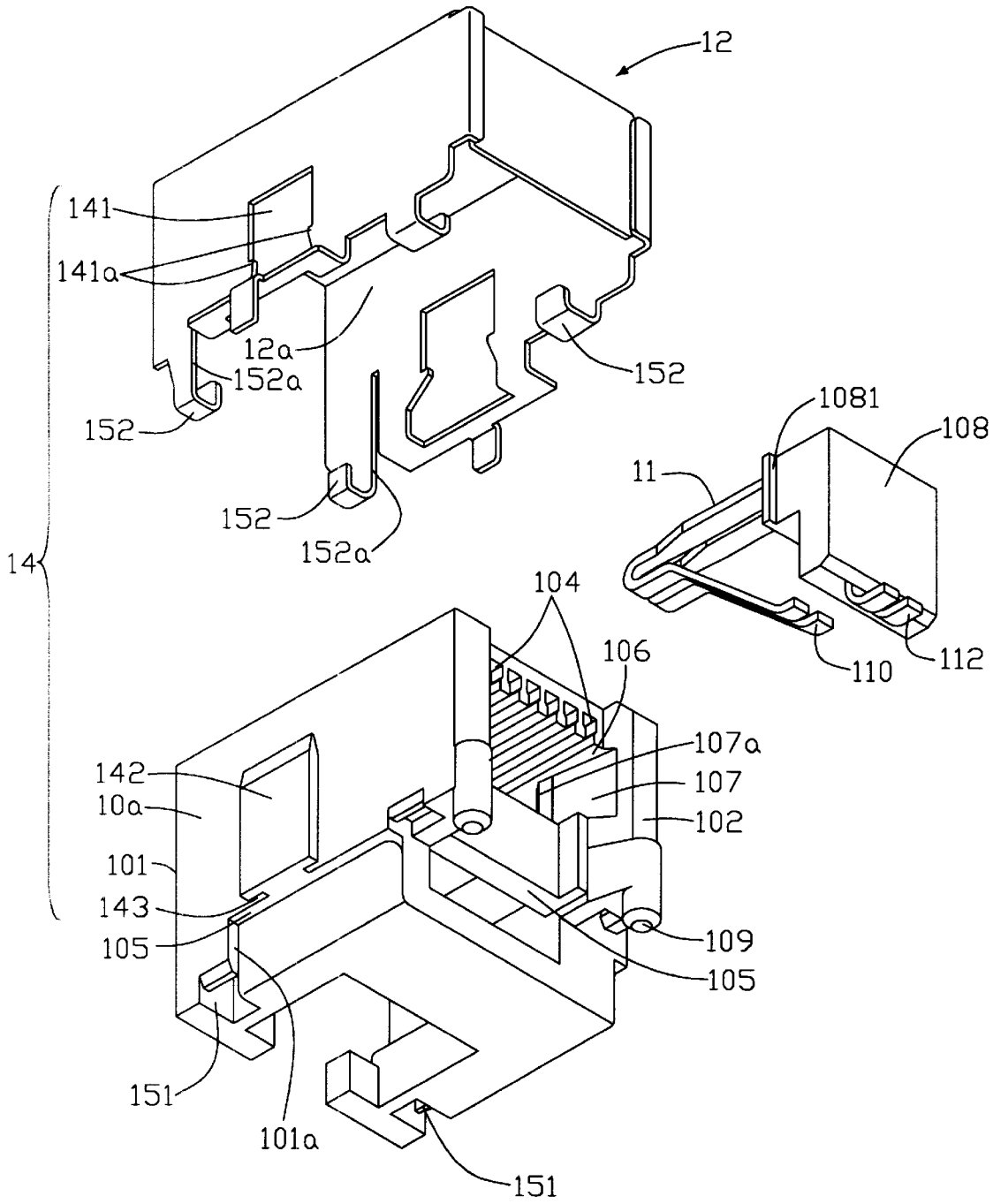
FIG. 4 is still an exploded view of the electrical connector taken from a reverse angle.
Figure 5:
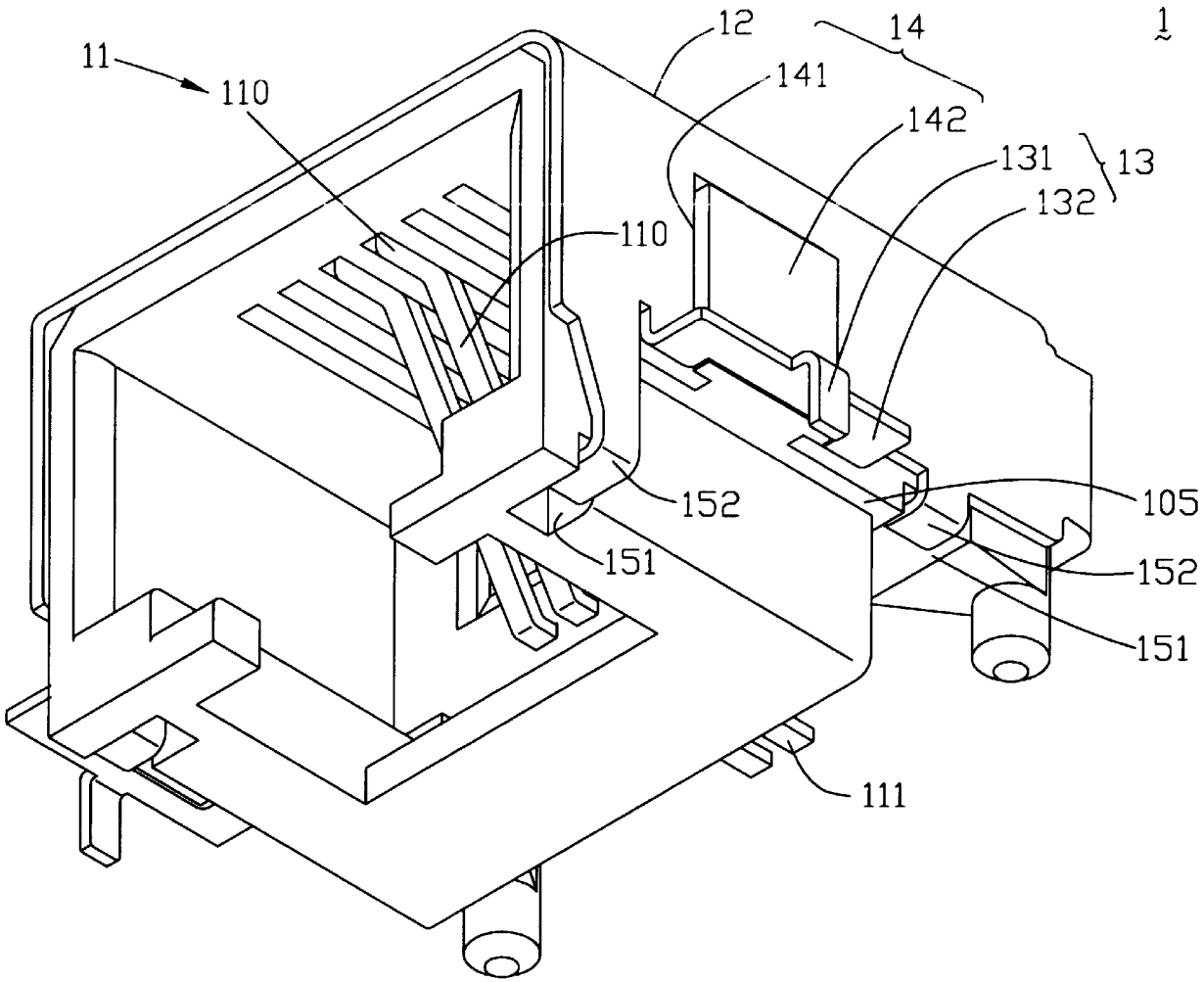
FIG. 5 is an assembled view of FIG. 3.
Figure 6A:
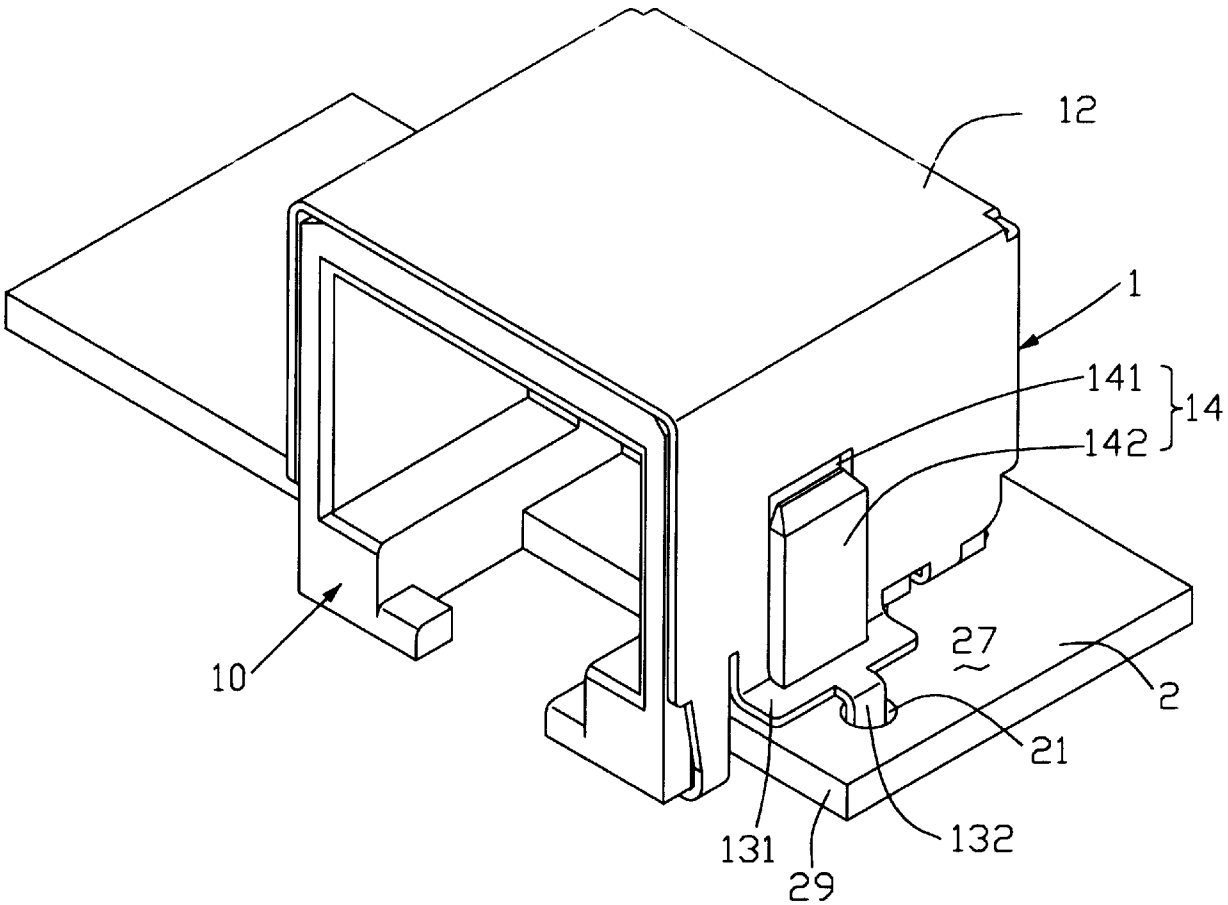
FIGS. 6A is a perspective view of an electrical connector mounted to a printed circuit board.
Figure 6B:
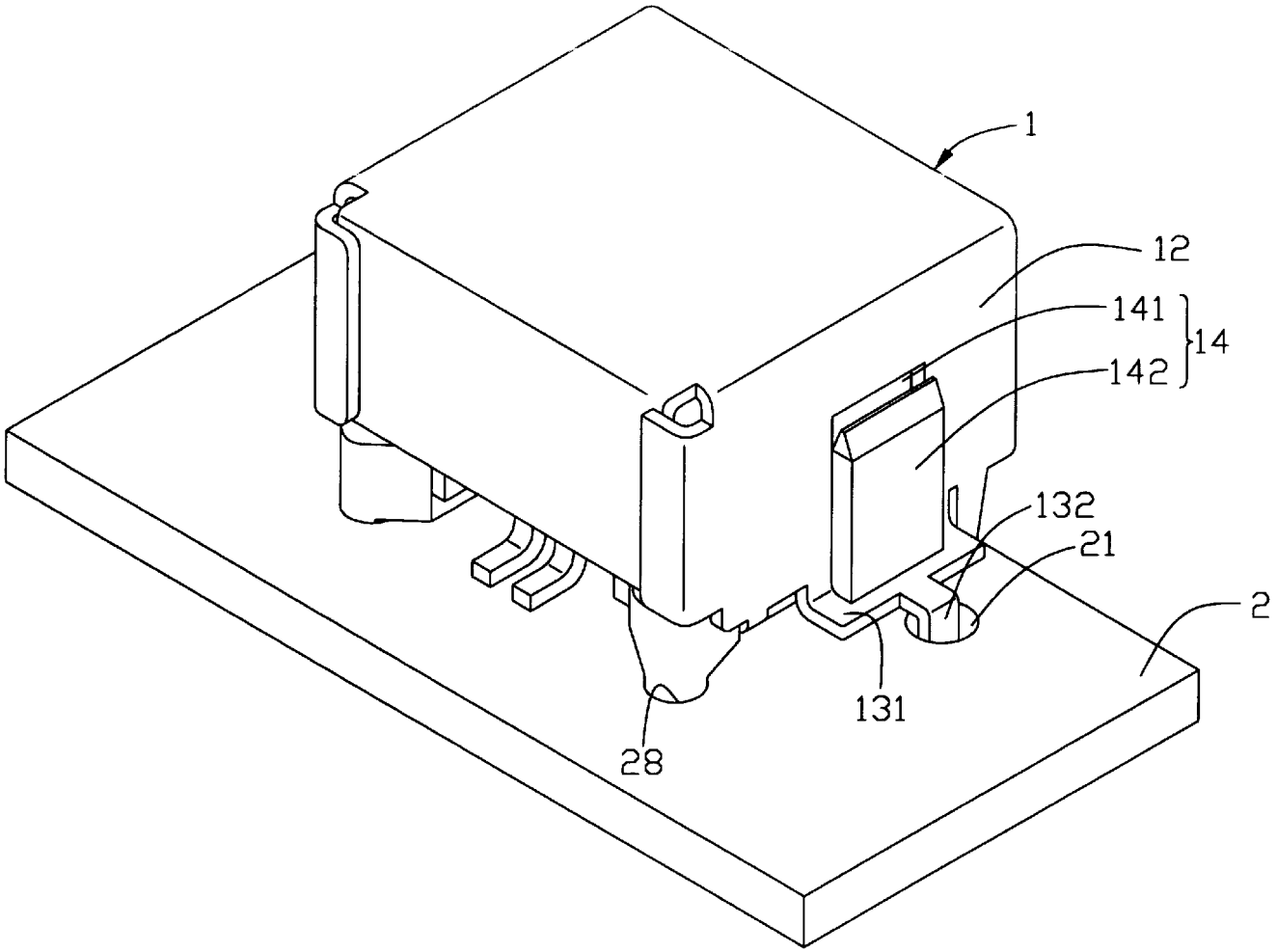
FIG. 6B is a perspective view of FIG. 6A taken from a reverse angle.
Figure 6C:
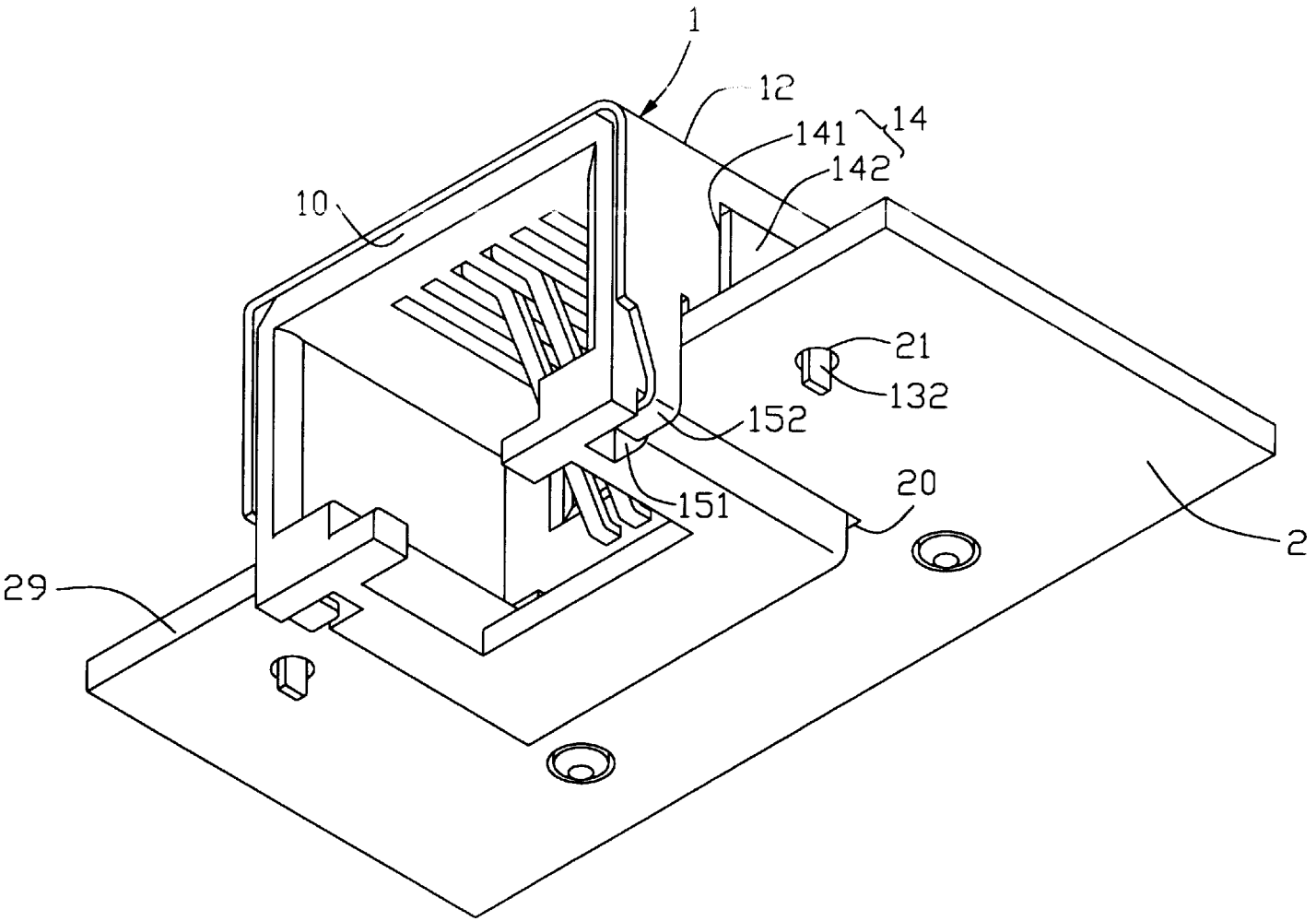
FIG. 6C is a perspective view of FIG. 6C taken from a bottom direction.
Figure 6D:
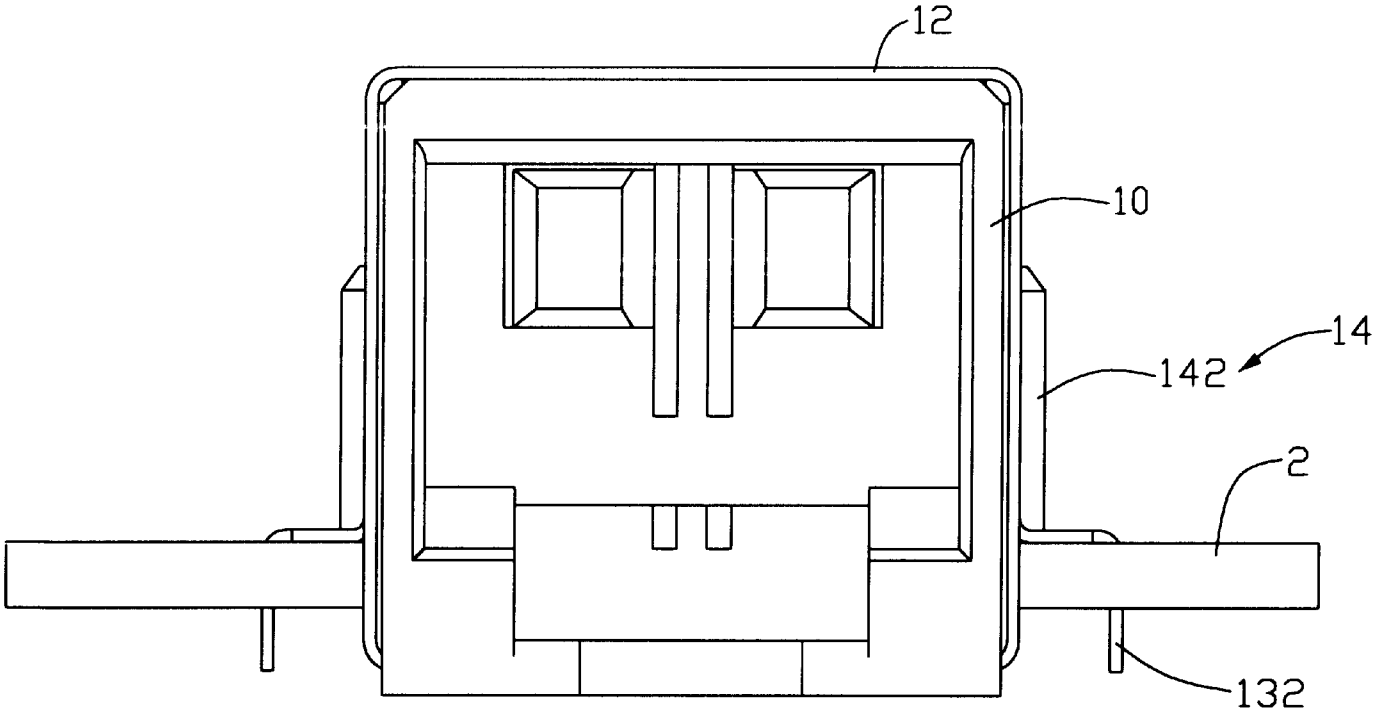
FIG. 6D is a front view of FIG. 6A.

Referring to FIGS. 3, 4, 5 and 6A to 6D, an electrical connector 1 in accordance with the present invention comprises a dielectric housing 10 having a plurality of terminals 11 assembled therein. An EMI shield 12 is assembled to the housing 10. The housing 10 has a mating face 101 and a connecting face 102 opposite to the mating face 101. The mating face 101 defines a front opening 103 for insertion of a complementary connector (not shown). The housing 10 defines six elongate slots 104 for receiving the terminals 11 therein. Shoulders 105 are formed on lower portion of side walls 10*a* for abutting against a top surface 27 of a printed circuit board 2 (FIG. 6A). The connecting face 102 defines a rear opening 106 for insertion of an insert 108 carrying the terminals 11. The housing 10 further forms a pair of inclined surface 107 adjacent the rear opening 106. The insert 108 forms flanges 1081 on opposite ends which snugly seals the rear opening 106 when the insert 108 is assembled. The surface 107 forms a retaining rib 107*a* for engaging with the flange 1081 of the insert 108. Positioning posts 109 extend from bottom of the housing 10 for accurately positioning the housing 10 to the printed circuit board 2.

In this embodiment, only two terminals 11 are assembled to the insert 108. The terminals 11 can be increased to four or six according to different applications. Each terminal 11 includes a connecting arm 110 and a body portion 111 integrally formed with the insert 108. The terminal 11 further forms a solder tail 112 for soldering to the printed circuit board 2. A horizontal portion of the connecting arm 110 is retained in the corresponding slot 104 while an inclined portion extends into an inner space of the housing 10.

The EMI shield 12 has top, side and rear walls defining a receiving space 12*a* for receiving the housing 10 therein. The EMI shield 12 forms a pair of lugs 131 extending horizontally from the side walls 12*b* thereof. The lugs 131 flush to the shoulder 105 and abut against to the printed circuit board 2. A grounding tang 132 extends from the lug 131 and is received in a hole 21 of the printed circuit board 2. The EMI shield 12 forms four hooks 152 engaged to the housing 10. Each hook 152 engages in a recess 151 defined in the housing 10.

Interconnecting means is provided between the housing 10 and the EMI shield 12 for snugly attaching the EMI shield 12 to the housing 10. The interconnecting means includes a pair of slots 141 defined in side wall of the EMI shield 12 and a pair of wedges 142 formed on the side walls 10*a* of the housing 10. A bottom face of the wedge 142 flushes to the shoulder 105 for abutting against to the printed circuit board 2. Retaining grooves 143 is defined between the wedges 142 and the side wall 10*a* for securely receiving sides 141*a* of the slot 141. By this arrangement, the EMI shield 12 can be accurately positioned on the housing 10. In addition, with the engagement between the hooks 152 and the recesses 151, the EMI shield 12 is firmly attached to the housing 10.

With the provision of the shoulders 105, the lugs 131, and the wedges 142, the connector 1 can be snugly seated in a recess 20 of the printed circuit board 2. Because a lower portion of the connector 1 is received in the printed circuit board 2, the overall height is reduced thereby providing a robust space for mounting electrical components under the printed circuit board 2.

It can be seen that the shoulders 105 are provided along the two sides and the rear portion of the housing 10, so the connector 1 may be supportably seated on the corresponding recess 20 of the printed circuit board 2. Moreover, referring to FIG. 4, the vertical section 152*a* of the front hook 152 and the vertical engaging surface 101*a* of the housing 10 may engage the front edge 29 of the board 2 so the mating face 101 of the housing 10 may protrude out of the recess 20 of the board 2 and spaced from the front edge 29 of the board 2 in a distance for easy access. The engagement of the housing 10 with the front edge 29 of the board 2 cooperates with the positioning post 109 and the grounding tang 132 respectively received within the corresponding holes 21, 28 (FIG. 6B) so that the connector 1 may be retained in position without moving in a front-to-back direction.

While the present invention has been described with reference to specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. An electrical connector, comprising:

a dielectric housing defining front, rear, top, bottom and side walls, said front wall defining a receiving chamber therein;

an insert detachably assembled to said rear wall of said housing, said insert carrying terminals each having a connecting arm extending into said receiving chamber; and positioning means formed on said side walls and including a pair of wedges formed on side walls of said housing and distant to said bottom wall of said housing, a pair of retaining grooves defined between said wedges and said side walls, whereby said housing is snugly disposed in a recess defined in a printed circuit board.

2. The electrical connector as recited in claim 1, wherein a ceiling of said receiving chamber defines elongate slots for snugly receiving connecting arms of said terminals.

3. The electrical connector as recited in claim 1, wherein bottom faces of said wedges abut against peripheral edges of said recess of said printed circuit board when said housing is assembled thereto.

4. The electrical connector as recited in claim 1, wherein an EMI shield is assembled to said housing.

5. The electrical connector as recited in claim 4, wherein said EMI shield includes at least a lug for abut against said printed circuit board, and a grounding tang extending from said lug.

6. The electrical connector as recited in claim 4, wherein said EMI shield includes at least a pair of hooks engaging with bottom surfaces of said housing.

7. The electrical connector as recited in claim 4, wherein side walls of said EMI shield includes slots having its sides snugly received in said retaining grooves of said housing.

* * * * *